United States Patent [19]

Frank

[11] Patent Number: 4,845,905

[45] Date of Patent: Jul. 11, 1989

[54] SKYLIGHT LATCH

[75] Inventor: Wilhelm Frank, Leinfelden, Fed. Rep. of Germany

[73] Assignee: Wilh. Frank GmbH, Leinfelden-Echterdingen, Fed. Rep. of Germany

[21] Appl. No.: 200,593

[22] Filed: May 31, 1988

[30] Foreign Application Priority Data

May 28, 1987 [DE] Fed. Rep. of Germany ..... 3718040

[51] Int. Cl.[4] ..... E05F 1/00

[52] U.S. Cl. ..... 52/72; 52/200; 292/278; 292/338; 49/379; 49/386

[58] Field of Search ..... 52/200, 72; 292/278, 292/338, 262; 49/379, 158, 386; 98/86

[56] References Cited

U.S. PATENT DOCUMENTS

| | | | |
|---|---|---|---|
| 1,693,860 | 12/1928 | Olson | 292/338 |
| 1,875,873 | 9/1932 | Johnson | 292/278 |
| 2,643,420 | 6/1953 | Schwartz | 292/278 |
| 2,677,565 | 5/1954 | Loomis | 292/278 |
| 3,182,581 | 5/1965 | Von Poederoyen et al. | 52/72 |
| 3,557,497 | 1/1971 | Schafer et al. | 52/72 |
| 3,903,661 | 9/1975 | Gobel | 52/72 |
| 4,021,073 | 5/1977 | Manning | 52/72 |
| 4,043,128 | 8/1977 | Bendler et al. | 98/86 |
| 4,078,779 | 3/1978 | Molders | 292/278 |
| 4,090,437 | 5/1978 | Bogaert | 98/86 |
| 4,208,840 | 6/1980 | Jentoft et al. | 49/386 |
| 4,416,094 | 11/1983 | Bugener et al. | 49/379 |

FOREIGN PATENT DOCUMENTS

| | | | |
|---|---|---|---|
| 278987 | 1/1914 | Fed. Rep. of Germany | 52/72 |
| 6414776 | 6/1966 | Netherlands | 52/72 |

*Primary Examiner*—David A. Scherbel
*Assistant Examiner*—Caroline D. Dennison
*Attorney, Agent, or Firm*—Kurt Kelman

[57] ABSTRACT

A skylight, having a wing actuated by pneumatic springs, can be moved to an emergency opening position thereby substantially exposing the opening area of the skylight case. The skylight also acts as a residential ceiling or attic skylight which has, in the normal open position, a considerably smaller opening than in the emergency open position. A locking device is provided to restrict the long extension stroke of the piston rod of the pneumatic springs to a partial stroke. This partial stroke allows an opening which essentially corresponds to the standard opening of the wing in a residential skylight. The locking device, located on the cylinder of the pneumatic spring, includes a specially designed latch which, in order to effect partial stroke restriction of the piston rod, lockingly engages a stop located on the side of the case by means of a catch pin.

11 Claims, 3 Drawing Sheets

SKYLIGHT LATCH

BACKGROUND OF THE INVENTION

1. Field of the Invention

The invention relates to a skylight having a case, wing and weight-balancing device and having at least one pneumatic spring. More particularly, the invention relates to a skylight where the pneumatic spring is pivotably attached at one end to the case and to the wing at its other end. Thus the wing, after being unlocked from the case, automatically opens under the effect of the pneumatic spring and when the stroke of the piston rod is fully extended from the cylinder of the pneumatic spring, the wing is brought into an emergency open position in which the opening of the case is entirely exposed.

2. Description of the Prior Art

In skylights which may be used as emergency exits, the weight-balancing device generally comprises pneumatic springs which exhibit strokes allowing for a relatively long extension of the piston rod out of the cylinder. When the wing is opened, the size of the opening is controlled by the angular position of the wing relative to the case. In the emergency opening position, the angle between the opened wing and the surface plane of the case is generally in excess of 90°. In this arrangement, the wing is designed as a wing or flap and is hinged to the rear of the case by virtue of hinges mounted on a horizontal rear spar of the case. Alternately, the wing may be pivotable by virtue of hinges mounted on the longitudinal spars on the sides of the case.

For a skylight whose wing is constructed as a flap or pivotable wing, the pneumatic spring can either be mounted directly to the frame of the wing or indirectly to the wing by an intermediate member. This intermediate member may be an extension cover which overlaps the wing frame. If the wing is connected to the case by means of an underframe, then the pneumatic spring can act upon the underframe such that, when the wing is unlocked from the underframe, the wing can be opened like a wing flap. When the lock holding the wing to the underframe is released, it opens in a swinging fashion by pivoting about a horizontal hinge axis along the top of the underframe.

With traditional skylights, in their preferred construction for residential ceilings or attic spaces, the width or size of the opening for the wing is restricted. The pivoting wing or flap, when partially open, protrudes into the recess of the case partially blocking the opening and thereby restricting the free passage width of the case.

With skylights providing roof access, for example, for a chimney sweep or for an emergency exit, the opening so formed by the fully opened wing is to large to permit its use as a ceiling window. This is because such a skylight does not provide any adjustment for smaller angles for opening the wing as would be necessary for ventilation or viewing purposes, which angles must also, in particular, be storm-proof.

SUMMARY OF THE INVENTION

The object of the present invention is to provide a skylight which can be used both as an attic or ceiling skylight in residences and as an emergency exit.

A further object is to provide a skylight whose standard wing opening provides an opening consistent with the requirements of residential attic skylights, which opening can be easily transformed into an emergency opening with little effort.

Yet an additional object of the invention is to provide a skylight which is economical to manufacture, easy to install and simple to operate.

Accordingly, these objects are achieved by providing a skylight with a locking device which acts on the pneumatic spring, and by means of such a device, the extension stroke of the piston rod can be restricted in the unlocked state with respect to the case.

By utilizing an additional locking device, the extension stroke of the piston rod can be restricted. This results in the full extension stroke required to achieve the emergency open position of the wing being divided into a partial extension stroke. The partial stroke creates the customary opening of a residential attic or ceiling skylight so that the angle of aperture between the wing and the case is approximately between 30° and 45°. The skylight is thus rendered suitable for use as a residential attic or ceiling skylight. Only in the event access to the roof area is required should the locking device be released, whereupon the piston rod shifts the wing into the emergency fully open position. A further restricting of the extension stroke of the piston rod by means of the locking device restores the wing to its normal restricted opening.

According to one embodiment, the bearing for the eye of the piston rod of the pneumatic spring is mounted to the case, and the cylinder bearing or clevis of the pneumatic spring is mounted on the wing. The cylinder is equipped with a sleeve on which a latch having a catch pin is pivotably arranged in a manner which enables the catch pin to be positioned behind a stop mounted on the case. The locking device is thereby linked to the cylinder of the pneumatic spring, with the spring's piston rod facing the case. By virtue of the engagement of the latch to the stop located on the side of the case, the distance between the sleeve, and therefore the cylinder of the pneumatic spring, and the stop on the side of the case is restricted. Thus, the open position of the wing is maintained at an angle forming an aperture customary for residential attic skylights. Should the wing have to be brough to its emergency opening position, it is sufficient to merely release the catch pin from the stop. In this configuration, the locking device is joined to the pneumatic spring so that when the latch is released the pneumatic spring is again applied, opening the wing to the emergency position.

To achieve an automatic coupling of the catch pin in the latch with the stop, the pivoting axis of the latch is advantageously positioned in the area of the sleeve facing the wing. The latch is essentially parallel to the piston rod and positioned above the piston rod in a vertical plane which extends through the longitudinal axis of the piston rod, aligned perpendicularly with the window plane. The catch which is located above the piston rod shifts under the effect of its own weight into the locking position. Starting with the window in the closed position, the latch is thus always ready to shift to the locking position when the wing is opened. The wing can only be opened to a partial extent of its maximum opening angle because of the engagement of the rear of the latch's catch pin behind the stop located on the side of the case. Prior to its locking position, the latch rests on the eye of the piston rod or the piston rod itself and the catch pin is still at a distance from the stop on the side of the case. The distance of the catch pin from the locking point decreases as the opening angle of the wing increases, and when the catch pin on the side of the case comes to bear on and engage the stop, the opening angle of the wing is restricted at a predetermined position.

In order to enable the opening angle of the wing to be varied in the manner desirable for residential skylights, such as for adjusting for existing roof slopes, etc., it is advantageous to attach the sleeve supporting the latch such that it can be adjusted along the length of the cylinder of the pneumatic spring. The opening angle of the wing is reduced by sliding the sleeve on the cylinder in the direction of the wing (rearwardly on the case) or increased by sliding the sleeve in the direction towards the front of the case.

This extension adjustment capability can be easily provided by providing the sleeve with a longitudinal slot which is transversely penetrated by a tensioning screw. When the tensioning screw is loosened, the sleeve can be shifted to the desired new opening position of the wing and locked in position by tightening the tension screw to clamp the sleeve to the cylinder of the pneumatic spring.

A preferred embodiment untilizes the outer surface of the eye of the piston rod or the surface of the bearing holding the pin allocated to the eye as the stop for the catch pin. No additional loose parts or additional assembly steps are required for this locking device because the locking device is an integral component of the pneumatic spring and because the bearing for the eye of the piston rod or the eye itself forms the stop. The stop is therefore an integral part of an existing component.

In order to move the wing to its emergency open position from its partially open position, the locking device must be released. To accomplish this, the catch pin is disengaged from the stop on the side of the case, which action results in release of the full extension stroke of the pneumatic spring. Releasing the latch from the locked position is achieved without additional elements. During this operation, the catch pin of the latch, because of its own weight or because of an additional load medium, such as a spring engaging the latch, rests of the piston rod and slides along it. In reclosing the wing from the emergency open position, the catch pin rests on the piston rod and slides toward its stop. Because the eye of the piston rod constitutes a bulge with respect to the diameter of the piston, a recess is formed at this point. To enable the catch pin to transverse this recess unobstructed, it is advantageous to provide a bevelled surface on the catch pin.

To facilitate lifting the latch up out of the locked position, the latch may be provided with a gripping extension which makes it easier for the operator to disengage the latch by hand. This extension is required because when the latch engages the surface of the stop, such as the surface of the eye, it is under the pressure of the pneumatic spring and difficult to lift.

To reduce friction between the piston rod and the catch pin which rests thereon, it is advantageous as a minimum to cover the catch pin of the latch in plastic to avoid damaging the surface of the piston rod. This sheathing also provides for shock absorption when the catch pin engages the stop on the side of the case. The entire catch pin could also be made of plastic. Color coding the sheathing could alert the operator to the respective position of the latch or to its actuation.

It is customary for a skylight equipped with a pneumatic spring weight balancing device to provide pneumatic springs on both longitudinal sides of the skylight. If this is done, then each pneumatic spring is equipped with a latch and the movements of both latches are linked to one another so that only one latch must be actuated resulting in both latches being simultaneously released from the locked position. Also, both latches would then engage simultaneously so that the catch pins would engage in the locking position behind the stop at the same time.

So that the pneumatic springs are not visible from inside the room when the wing is in the closed position, the pneumatic spring are usually arranged in the surface plane of the longitudinal spars of the case. Thus, the bearing for each pneumatic spring is mounted on the front side of the longitudinal spar of the case. In the closed position, the pneumatic spring is arranged laterally beside the wing frame, covered by a wing cowling or an underframe which also overlaps the wing frame and which additionally may be overlapped by a wing cowling. The wing covering serves as a support for the bearing of the second end of the pneumatic spring. The bearings for the pneumatic springs on the side of the case are so positioned in the plane of the longitudinal spar of the case to be in line or to be only slightly offset from the bearing on the side of the wing where the pneumatic springs engage. It is therefore necessary for the operator to initially apply a great deal of force to the wing at the start of the wing opening operation.

To facilitate the start of the wing opening operation, the wing, in the vicinity of the horizontal hinge axis, has been provided with a pressure spring which acts in conjunction with the upper or front side of the longitudinal spar of the case. The pressure spring, which is preferably a coil spring, is compressed and thereby pretensioned when the wing is closed so that when the closed wing is unlocked, the wing is raised as a result of the spring tension of the pressure spring. The coil spring is sized so that the case is raised to a position where the tension of the pneumatic spring can assist and take over the continued opening movement of the wing. The pressure spring therefore serves as an auxiliary weight balancing device.

In this regard, it is advantageous to mount a pressure plate on the upper side of the case for the pressure spring to act on.

BRIEF DESCRIPTION OF THE DRAWINGS

Further advantages and details can be gleaned from the drawings wherein like reference numerals denote like elements throughout the several views.

DESCRIPTION OF THE PREFERRED EMBODIMENTS

Figure 1:
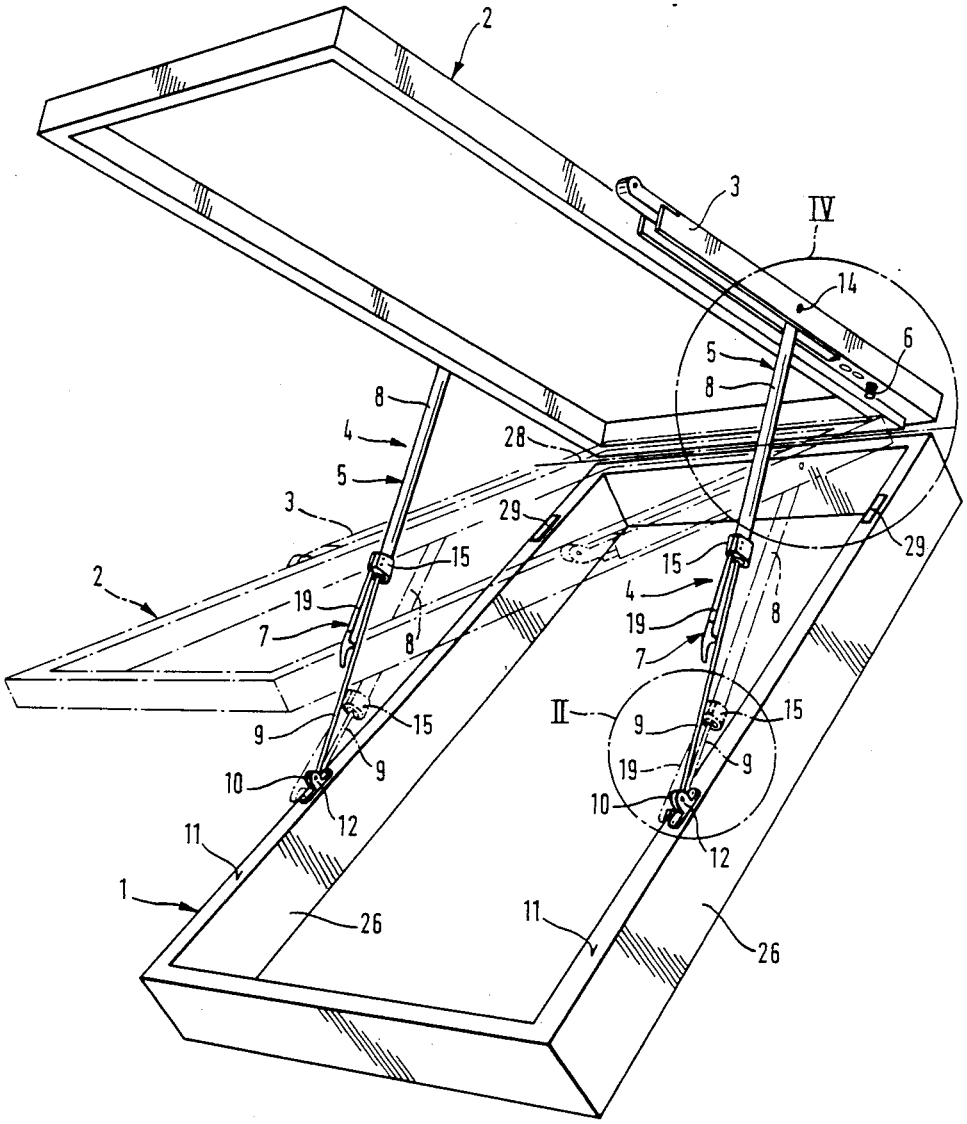
FIG. 1 is an isometric view of a built-in skylight, with its wing fully open shown in full lines and partially shown open in phantom lines and whose weight-balancing device is comprised of pneumatic springs.

Referring to FIG. 1, there is shown a skylight consisting of a case 1, to which a wing 2 is indirectly hinged via an auxiliary frame 3. A respective weight-balancing device consisting of pneumatic spring 5 assisted by coil pressure spring 6 on each side of the skylight. A locking device 7 is mounted on the pneumatic spring.

Figures 2, 3:
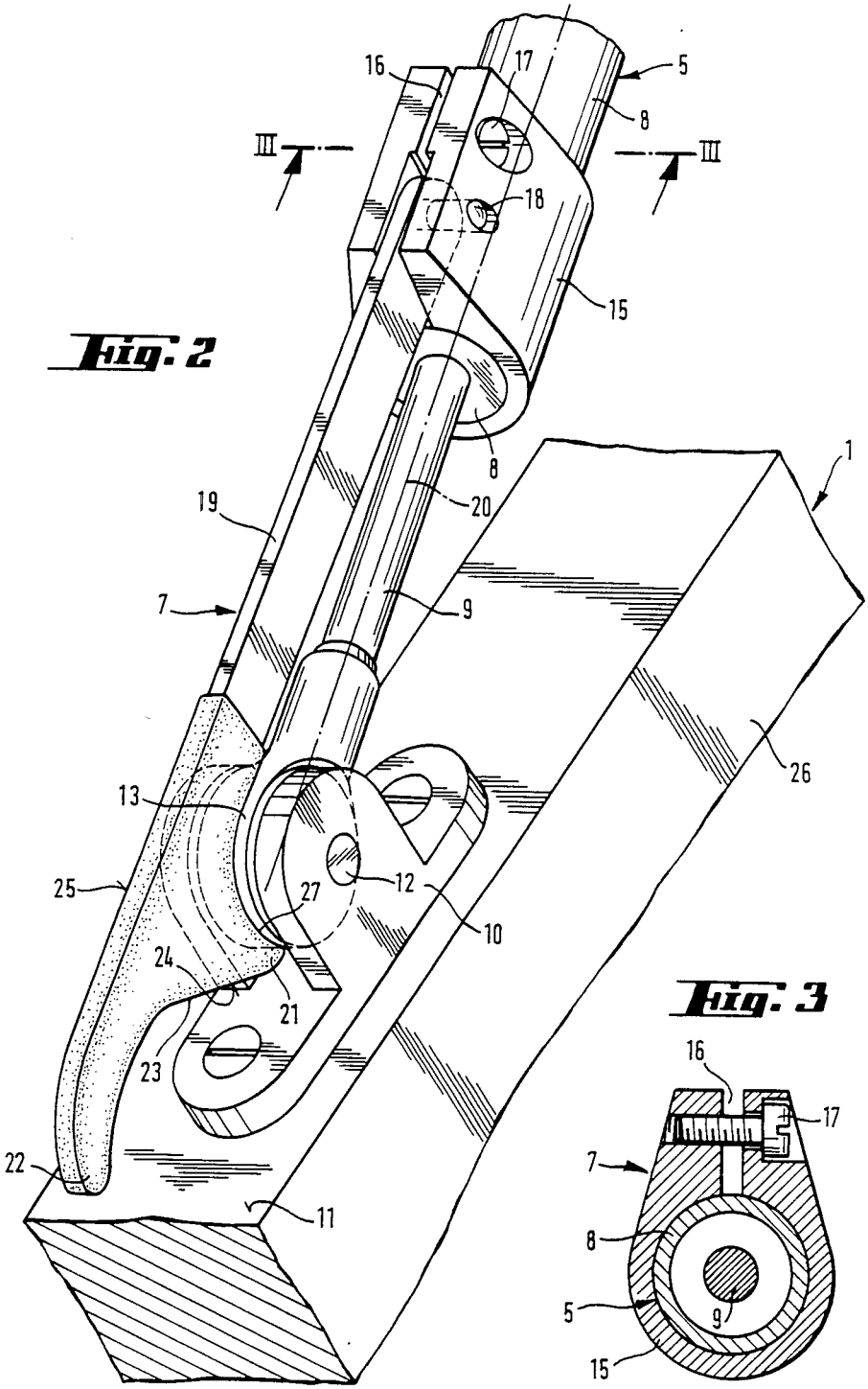
FIG. 2 is an enlarged isometric view of the locking device connected to the pneumatic spring of FIG. 1.
FIG. 3 is a cross-sectional view along section III—III of FIG. 2.
Figure 4:
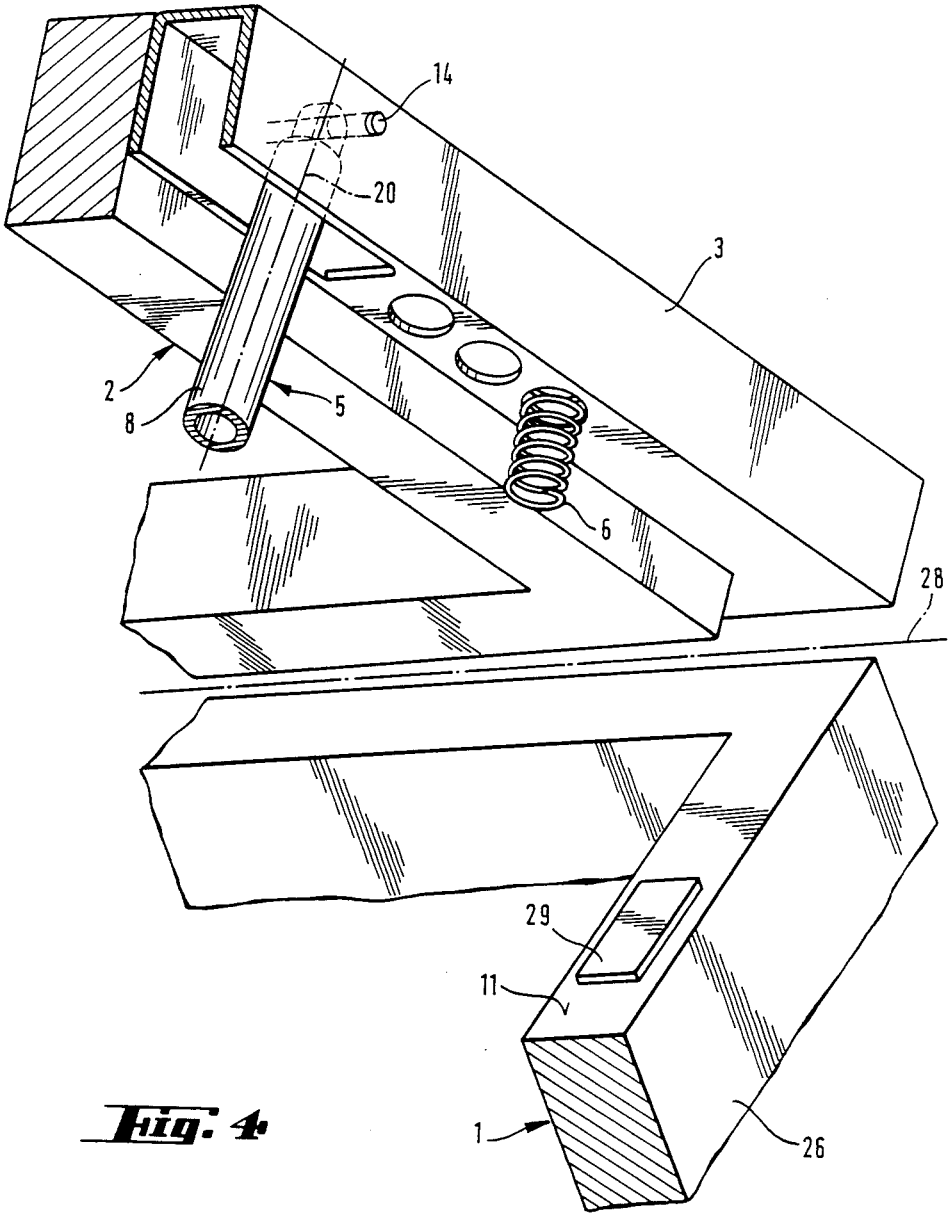
FIG. 4 is an enlarged isometric view of the rear of the case, with the wing open.

Referring to FIG. 2, it is shown that pneumatic spring 5 consists of a cylinder 8 in which a piston is mounted on a piston rod 9 and is pressure-loaded by gas. The pneumatic spring 5 is pivotally mounted at one end on case 1, namely, in a bearing or hinge block 10 which is mounted on the upper side 11 of the longitudinal spar 26 of case 1. In this configuration, a hinge pin or bearing bolt 12 is received in eye 13 of piston rod 9. The other end of pneumatic spring 5 (i.e., the end with cylinder 8) is mounted on auxiliary frame 3 and is pivotably held thereon by a bearing 14. Cylinder 8 of pneumatic spring 5 supports, adjacent to its end on the case side, a sleeve 15 which has a longitudinal slot 16 which is transversed by tensioning screw 17.

Sleeve 15 is equipped, in the area facing wing 2, that is, above piston rod 9, with a pivoting axis 18 which is in a horizontal plane, on which axis a latch 19 is positioned. Latch 19 extends essentially parallel to piston rod 9 and is positioned above the piston rod in the vertical plane which extends through the longitudinal axis 20 of piston rod 9 which vertical plane is perpendicularly aligned with the plane of a window in wing 2..

Near the free end of latch 19, there is a catch pin 21 which includes a grip 22 for releasing the latch. The back 23 of catch pin 21 is bevelled to form a cam surface 24. Catch pin 21 includes stop 27 which is designed to engage a stop on case 1 as will be hereinafter described. The operating surface of catch pin 21 and the surface 24 are made of plastic or are covered by a sheathing 25 made of plastic.

In the closed position, wing 2 rests upon and is locked against case 1. In this configuration, pressure spring 6, which is located close to the horizontal hinge axis 28 of the skylight in the area of longitudinal spar 26 of case 1, is compressed against pressure plate 29 on case 1 and the piston rod of pneumatic spring 5 is fully retracted in cylinder 8. Latch 19 rest under its own weight on eye 13 of piston rod 9, in which configuration catch pin 21 is positioned at a distance from and below bearing 10 on the side of case 1.

Following release of the lock (not shown) which holds wing 2 against case 1, the stored energy of coil spring 6 causes wing 2 to pivot about hinge axis 28. This raises wing 2 a few degrees above the plane of case 1 and causes sufficient rotating motion between pivot point 14 and pivot point 10 to allow pneumatic spring 5 to act. The force produced by pressure spring 6 produces a sufficient moment to offset or raise pivot point 14 on auxiliary frame 3 of wing 2 with respect to pivot pin 12 of hinge 10 about hinge axis 28. This enables the energy of pneumatic spring 5, in turn, to more effectively act upon wing 2. During the opening movement of wing 2, latch 19 slides along the outer surface of eye 13 of piston rod 9 in the direction of bearing 10. The pressure spring 6 rises up from its pressure plate 29 on the upper side 11 of case 1 and weight compensation is taken over exclusively by pneumatic spring 5.

The opening movement of the wing 2 under the effect of pneumatic spring 5 stops when stop 27 of the catch pin 21 catches on the outer surface of eye 13 of piston rod 9 or on the outer circular surface 30 on bearing or hinge block 10. As a consequence of the engaging action of step 27, either with circular portion 30 on bearing 10 or with the surface of eye 13 of piston rod 9 (which is pivotably arranged in bearing 10), the extension stroke of piston rod 9 is restricted. The point where the opening of wing 2 is stopped is predetermined to be the equivalent of the standard opening angle of wing 2 with respect to case 1 for residential attic or ceiling skylights. When wing 2 is closed again, stop 27 of catch pin 21 disengages and latch 19 slides downward along piston rod 9. Thus, the skylight, in normal operation, can always be set in the standard opening positioned for a residential skylight.

If it is necessary, however, to abondon the living quarters beneath the roof through the opening of case 1, then wing 2, as hereinbefore described, is brought to the intermediate open position shown in phantom in FIG. 1, which position corresponds to the standard opening width for residential skylights discussed above. Once this open position has been achieved, latch or latches 19 are held by means of the grip 22 and raised so that the stop 27 of catch pin 21 is disengaged from the outer surface of bearing 10 or eye 13. This neutralizes the locking effect exerted on pneumatic spring 5 and allows the pressure of pneumatic springs 5 to effect a further automatic lifting of wing 2 into the emergency fully open position illustrated in FIG. 1. As wing 2 rises, catch pin 21 slides along the piston rod 9. In the emergency opening position, the opening in case 1 is substantially uncovered thereby allowing an individual to exit therethrough.

When closing wing 2 from the emergency open position, catch pin 21 of latch 19 slides downwardly along piston rod 9. Because of bevelled cam surface 24, latch 19 in passing from piston rod 9 over eye 13 at its end, is raised slightly and slides freely over and along eye 13 and/or bearing 10. Latch 19, as a consequence of its own weight, falls back in place with stop 27 again engaging the outer surface of eye 13 or bearing 10 when grip 22 of catch pin 21 has left the area of eye 13. This results in the automatic restriction of the extension stroke of piston rod 9 again to the standard opening for a residential skylight without necessitating additional manipulation.

In order to set varying opening sizes intermediate the emergency open position for wing 2 or to adjust for varying roof slopes, sleeve 15, following release of the tensioning screw 17, may be slid longitudinally and may be relocked at the desired location by tightening tensioning screw 17. Sleeve 15 is in the form of a hollow cylinder having a longitudinal slot through the wall thereof.

By virtue of automatic locking device 7 used to automatically restrict the extension stroke of piston rod 9 of pneumatic spring 5, a skylight is provided having an unrestricted opening which can also be used as a residential skylight providing a standard opening position. In addition, when required, a simple raising of latch 19 causes wing 2 to open into an emergency fully open position. Upon subsequent closing, latch 19 automatically reassumes its function of restricting the extension stroke of piston rod 9. This is achieved by a simple structure which is easy for the average person to operate and which does not require additional skylight installation procedures.

The inner diameter of the hollow cylindrical sleeve is just large enough to slide over the outer surface of cylinder 8 with screw 17 untensioned. Subsequent tensioning of screw 17 locks sleeve 15 in position along cylinder 8.

While the foregoing description is illustrative of the present invention, various modifications and embodiments have been suggested and others will be readily available to those skilled in the art. Accordingly, it is intended that the present invention be limited only by the scope of the appended claims.

What is claimed is:

1. A skylight comprising (a) a case defining an opening;

(b) a wing mounted thereon for pivoting about a horizontal axis;

(c) a weight-balancing means including at least one extendable pneumatic spring comprising a cylinder, a piston movable therein and an extendable piston rod coupled to the piston, the cylinder having a free end pivotably attached to said wing and the piston rod having an eye at a free end thereof pivotably attached to said case, the eye having a stop surface thereon, and said pneumatic spring being capable of extending under a pneumatic force sufficient to pivot said wing with respect to said case about said horizontal axis from a first closed position to a second opened position in which the opening defined by the case is substantially exposed;

(d) a bearing fixed to the case for mounting the eye of the piston rod;

(e) a hollow cylindrical sleeve surrounding, and fixedly coupled to the cylinder of the pneumatic spring; and (f) locking means operatively connected to the pneumatic spring for releasably locking the pneumatic spring in a partially extended position wherein the wing is held in a third position intermediate the first and second positions with respect to said case, the locking means comprising (1) a latch having a first and a second end, the first latch end being pivotably mounted on the hollow cylindrical sleeve for pivoting about an axis extending substantially perpendicular to a longitudinal axis of the piston rod, and the second latch end having a catch for engaging the stop surface of the eye.

2. The skylight as set forth in claim 1, wherein the pivoting axis for the latch is positioned at an end of the sleeve facing the wing and the latch extends essentially parallel to the piston rod and positioned above the piston rod in a vertical plane which extends through the longitudinal axis of the piston rod which vertical plane is perpendicularly aligned with the plane of said wing.

3. The skylight as set forth in claim 1, wherein the sleeve supporting the latch includes means for adjusting the position thereof along said cylinder of the pneumatic spring.

4. The skylight as set forth in claim 1, wherein the cylindrical sleeve is provided with a longitudinal slot through a wall thereof and the longitudinal slot is transversely penetrated by a tensioning screw.

5. The skylight as set forth in claim 1, wherein the stop surface for the catch is an outer surface of the eye of the piston rod.

6. The skylight as set forth in claim 1, wherein said catch has a bevelled cam surface for engaging a complementary surface on said bearing including said eye mounted therein.

7. The skylight as set forth in claim 1, wherein the latch is equipped with a gripping means for releasing said latch from said stop surface.

8. The skylight as set forth in claim 1, wherein the catch of the latch is covered with sheathing made of plastic.

9. The skylight as set forth in claim 1, wherein said case includes two longitudinally extending sides at opposite sides of the opening, and comprising a respective extendable pneumatic spring, bearing, hollow cylindrical sleeve and latch mounted between said wing and each longitudinal side of said case.

10. The skylight as set forth in claim 9, further including a pressure spring means mounted on said wing and acting on a pressure plate mounted on an upper side of said longitudinal side of said case, said pressure spring means being disposed between said case and said wing adjacent said horizontal axis of the wing, and acting to provide the initial movement of said wing from said first closed position toward said second and third open positions.

11. The skylight as set forth in claim 10, wherin said pressure spring means is a coil spring.

* * * * *